US005910638A

United States Patent [19]

Spencer et al.

[11] Patent Number: 5,910,638

[45] Date of Patent: Jun. 8, 1999

[54] HIGH DENSITY TUNGSTEN-LOADED CASTABLE EXPLOSIVE

[75] Inventors: Arthur F. Spencer; Gary H. Parsons, both of Niceville, Fla.

[73] Assignee: The United States of America as represented by the Secretary of the Air Force, Washington, D.C.

[21] Appl. No.: 08/969,936

[22] Filed: Nov. 28, 1997

[51] Int. Cl.[6] ..... C06B 45/06

[52] U.S. Cl. ..... 149/18; 149/18; 149/9.2; 149/105; 149/19.1; 149/108.2

[58] Field of Search ..... 149/18, 9.2, 105, 149/19.1, 108.2

[56] References Cited

U.S. PATENT DOCUMENTS

| | | | |
|---|---|---|---|
| 3,528,864 | 9/1970 | Weinland | 149/92 |
| 4,088,518 | 5/1978 | Kehren et al. | 149/92 |
| 4,331,080 | 5/1982 | West et al. | 149/92 |
| 4,405,534 | 9/1983 | Deisenroth | 149/2 |
| 4,445,948 | 5/1984 | Stanton et al. | 149/18 |
| 4,747,892 | 5/1988 | Spencer | 149/92 |
| 5,431,756 | 7/1995 | Kosowski et al. | 149/18 |
| 5,529,649 | 6/1996 | Lund et al. | 149/92 |
| 5,716,557 | 2/1998 | Strauss et al. | 149/18 |

*Primary Examiner*—Edward A. Miller
*Attorney, Agent, or Firm*—Charles E. Bricker; Thomas L. Kundert

[57] ABSTRACT

A castable explosive composition consisting essentially of about 50 to 90 weight percent tungsten powder, about 3 to 40 weight percent of a high energy explosive, about 3 to 16 weight percent of an energetic binder, and about 2 to 10 weight percent aluminum powder. The aluminum powder acts as a processing aid, virtually eliminating tungsten settling.

9 Claims, No Drawings

HIGH DENSITY TUNGSTEN-LOADED CASTABLE EXPLOSIVE

RIGHTS OF THE GOVERNMENT

The invention described herein may be manufactured and used by or for the Government of the United States for all governmental purposes without the payment of any royalty.

BACKGROUND OF THE INVENTION

This invention relates to an improved explosive composition.

In general, high explosives are compositions and mixtures of ingredients capable of instantaneously releasing large amounts of energy and doing work of various kinds on objects and bodies surrounding them. In some cases the useful work that is done is limited only by the energy content of the explosive composition, while in other cases the transfer of energy from the explosive composition to surrounding bodies is controlled to a large degree by the momentum or impulse released by the detonating explosive.

Tungsten and other heavy metals, such as depleted uranium (DU), have been used in shaped charges, as the penetrator case or as a liner within the case. In the case of military warheads, the purpose has been to increase the total weight of the warhead for better penetration performance. With current environmental concerns, tungsten has been the preferred heavy metal, since it is essentially inert.

However, structural strength limitations have been experienced with tungsten liners in large penetrator warheads. At the same time, fabrication of tungsten liners and cases is costly. Further, concentration of heavy metal at the walls of warheads degrades fragmentation performance.

Weinland, U.S. Pat. No. 3,528,864, issued Sep. 15, 1970, discloses several high impulse explosive compositions containing tungsten, one of which consists essentially of about 50 to 75 weight percent tungsten and about 25 to 50 weight percent trinitrotoluene (TNT). Such composition presents at least two problems: one, the tungsten powder tends to settle during solidification of the mixture, and may do so unevenly, depending on the mold shape; and, two, the explosive compositions are limited to a relatively small range of densities due to proccessability and settling problems.

It is an object of the present invention to provide a castable, tungsten-containing composition for use in penetrator warheads to significantly increase total weight, thereby increasing penetration of hardened targets.

Other objects and advantages of the present invention will be apparent to those skilled in the art.

SUMMARY OF THE INVENTION

In accordance with the present invention there is provided a castable explosive composition consisting essentially of about 50 to 90 weight percent tungsten powder, about 3 to 40 weight percent of a high energy explosive, as hereinafter defined, about 3 to 16 weight percent of an energetic binder, as hereinafter defined, about 2 to 10 weight percent aluminum powder and, optionally, about 0.05 to 1.0 weight percent, of microcrystalline wax.

Suitable high energy explosives for use in the present invention include 1,3,5,7-tetranitro-1,3,5,7-tetraazacyclooctane (HMX), 2,4,6,8,10,12-hexanitro-2,4,6,8,10,12-hexaazatetracyclo(5.5.0.0.<5,9>0<3,11>)-dodecane (CL-20, also known as HNIW), 1,3,5-trinitro-1,3,5-triazacyclohexane (RDX), 3-nitro-1,2,4-triazol-5-one (NTO), and the like, and mixtures thereof.

Suitable energetic melt/cast binders for use in the present invention include trinitrotoluene (TNT), 1,3,3-trinitroazetidine (TNAZ), and the like, or an energetic cast/cure binder such as nitroglycerine (NG) with 1,2,4-butanetriol trinitrate (BTTN), trimethylolethane trinitrate (TMETN), and the like, and mixtures thereof.

The aluminum powder acts as a processing aid, virtually eliminating tungsten settling. When TNT is used as the binder, TNT separation is also virtually eliminated. In addition, the aluminum contributes to blast performance.

The microcrystalline wax may be added to the composition to reduce friction and shock sensitivity.

The process used to formulate the tungsten-loaded explosive composition comprises the steps of (a) fluidizing the binder material, such as, for example, melting trinitrotoluene, and microcrystalline wax, if used, by heating in a steam jacketed stirred kettle to 85°–95° C.;

(b) adding aluminum powder to the fluid binder, with stirring;

(c) adding the high energy explosive(s) to the binder+aluminum mixture, with stirring;

(d) adding preheated (about 85° to 90° C.) tungsten powder to the binder+aluminum+high energy explosive mixture, with stirring;

(e) stirring the resulting mixture about 10 to 20 minutes;

(f) casting the mixture into a suitable mold, such as, for example, a munitions case; and (g) cooling to solidify.

We have prepared the following formulations (amounts are shown in weight percent):

| | | | | |
|---|---|---|---|---|
| Tungsten powder (27$\mu$) | 84% | 74% | 81% | 50% |
| HMX Class 3 | 7% | 14% | — | — |
| NTO | — | — | 7.5% | 24.0% |
| TNT | 7% | 8% | 7.5% | 16% |
| Aluminum powder (6–9$\mu$) | 2% | 4% | 3.75% | 9% |
| microcrystalline wax | — | — | 0.25% | 1.0% |
| Theoretical Maximum Density (grams/cm$^3$) | 7.7 | 5.72 | 7.02 | 3.45 |
| Energetic ingredients (volume percent) | 61 | 70 | 59 | 76 |

In each of these formulations, the charge densities were greater than 96% of theoretical maximum density (TMD). The cast charges required very little riser material (less than 15%) and machined very well.

The tungsten-loaded explosive compositions of this invention provide significant cost advantages over tungsten case and/or lined penetrator warheads since the tungsten powder is incorporated directly into the explosive matrix. The potential for structural failure of the warhead during penetration is expected to be less. The present invention allows the formulation of many density variations for warhead weight adjustments, thus meeting special air ballistics and detonation performance requirements.

The tungsten-loaded explosive compositions of this invention also provide significant advantages over tungsten-containing pressed explosives. These compositions eliminate severe punch and die wear problems, and are more flexible to ingredient changes. Whereas pre-pressed billets may require extensive machining and/or extremely close dimensional tolerances within a warhead case, the compositions of this invention can be cast directly into warheads.

Various modifications may be made in the instant invention without departing from the spirit and scope of the appended claims.

We claim:

1. A castable explosive composition consisting essentially of about 50 to 90 weight percent tungsten powder, about 3 to 40 weight percent of a high energy explosive, about 3 to 16 weight percent of an energetic binder, and about 2 to 10 weight percent aluminum powder.

2. The composition of claim 1 wherein said high energy explosive is 1,3,5,7-tetranitro-1,3,5,7-tetraazacyclooctane.

3. The composition of claim 1 wherein said high energy explosive is 3-nitro-1,2,4-triazol-5-one.

4. The composition of claim 1 wherein said energetic binder is trinitrotoluene.

5. The composition of claim 1 further containing about 0.05 to 1.0 weight percent microcrystalline wax.

6. The composition of claim 1 consisting of 84 w % tungsten powder, 7 w % 1,3,5,7-tetranitro-1,3,5,7-tetraazacyclooctane, 7 w % trinitrotoluene and 2 w % aluminum powder.

7. The composition of claim 1 consisting of 74 w % tungsten powder, 14 w % 1,3,5,7-tetranitro-1,3,5,7-tetraazacyclooctane, 8 w % trinitrotoluene and 4 w % aluminum powder.

8. The composition of claim 5 consisting of 81 w % tungsten powder, 7.5 w % 3-nitro-1,2,4-triazol-5-one, 7.5 w % trinitrotoluene, 3.75 w % aluminum powder and 0.25 w % microcrystalline wax.

9. The composition of claim 5 consisting of 50 w % tungsten powder, 24 w % 3-nitro-1,2,4-triazol-5-one, 16 w % trinitrotoluene, 9 w % aluminum powder and 1.0 w % microcrystalline wax.

* * * * *